US006426039B2

(12) United States Patent
Hirasawa et al.

(10) Patent No.: US 6,426,039 B2
(45) Date of Patent: Jul. 30, 2002

(54) FERRITIC STAINLESS STEEL

(75) Inventors: Junichiro Hirasawa; Atsushi Miyazaki; Mineo Muraki; Susumu Satoh, all of Chiba (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 09/892,370

(22) Filed: Jun. 27, 2001

(30) Foreign Application Priority Data

Jul. 4, 2000 (JP) ..... 2000-202296

(51) Int. Cl.[7] ..... C22C 38/52; C22C 38/54; C22C 38/46

(52) U.S. Cl. ..... 420/38; 420/39; 148/325

(58) Field of Search ..... 148/325; 420/38, 420/39

(56) References Cited

U.S. PATENT DOCUMENTS 3,990,892 A * 11/1976 Machi et al. ..... 420/37
5,772,956 A * 6/1998 Hasegawa et al. ..... 420/40

FOREIGN PATENT DOCUMENTS

| | | | |
|---|---|---|---|
| JP | 360155649 A | * | 8/1985 |
| JP | 04 280948 | | 2/1993 |
| JP | 07 126812 | | 5/1995 |
| JP | 09 184049 | | 7/1997 |
| JP | 411061342 A | * | 3/1999 |
| JP | 11 172369 | | 6/1999 |
| JP | 11 226738 | | 11/1999 |
| WO | WO 97 03216 | | 1/1997 |

* cited by examiner

*Primary Examiner*—Deborah Yee
(74) *Attorney, Agent, or Firm*—Schnader Harrison; Segal & Lewis LLP

(57) ABSTRACT

Ferritic stainless steel comprising all three of Co, V, and B, having a Co content of about 0.01 mass % to about 0.3 mass %, a V content of about 0.01 mass % to about 0.3 mass %, and a B content of about 0.0002 mass % to about 0.0050 mass %, and having superior secondary working embrittleness resistance and superior high temperature fatigue characteristics.

9 Claims, 5 Drawing Sheets

FERRITIC STAINLESS STEEL

BACKGROUND OF THE INVENTION

1. Field of the Invention

The present invention relates to a novel ferritic stainless steel. It particularly includes a welded ferritic stainless steel and welded product having superior secondary working embrittleness resistance and superior high temperature fatigue characteristics, and concerns welded parts that are suitable for applications in which a welded pipe or a welded plate, after having undergone forming work, is used.

The expression "secondary working" as used herein refers to the processing of a specified part after having already having subjected it to forming work. For example, a welded pipe may be subjected to bending work (primary working), and thereafter, to pipe diameter enlargement work (secondary working).

In known ferritic stainless steels, cracks due to brittleness are likely to form during secondary working.

The expression "high temperature fatigue" as used herein refers to a phenomenon wherein fatigue fracture of a material occurs due to repetitive bending at high temperatures of 600° C. or more.

For example, welded parts of components of an exhaust pipe system in an automobile undergo secondary working and high temperature fatigue. Among them, an exhaust manifold, as shown in FIG. 1 of the drawings, is subjected to severe conditions during operation, and undergoes intense vibration at high temperatures of 600° C. or more due to the action of engine exhaust gas. This is a typical example. The present invention is preferably applied to, for example, an exhaust manifold of ferritic stainless steel, and other welded products.

2. Description of the Related Art

When a welded pipe that has been subjected to complicated bending work, or pipe diameter enlargement or reduction is used, for example, as an exhaust manifold of an automobile, problems arise because cracks occur in welded parts that had already become brittle due to secondary working. Fatigue cracks occur in welded parts during use, due to insufficient strength at a high temperature.

The primary reason cracks are likely to occur in welded parts, rather than base materials, is that the toughness and strength of the welded parts deteriorate because crystal grains of the welded parts become coarse due to heat input during welding.

A ferritic steel containing an intervening material, $Al_2O_3$, has been suggested in Japanese Unexamined Patent Publication No. 11-172369. However, the aforementioned kind of steel exhibits insufficient secondary working embrittleness which causes cracks in the welded parts. Whether or not high temperature fatigue characteristics are achieved, serious cracks frequently occur as a result of the harmful secondary working embrittleness.

In order to reduce an intervening material introduced into the steel, $Al_2O_3$, Si or Mn must be used as a deoxidizer in the steel making process. Accordingly, Al, widely used as a deoxidizer, cannot be used in production of welded products free of defects caused by harmful secondary working embrittleness.

A ferritic stainless steel having improved secondary working embrittleness resistance by adding phosphide, and controlling its size and amount, was suggested in Japanese Unexamined Patent Publication No. 7-126812. When P is added, however, degradation of toughness of the welded product cannot be avoided. It is believed that this is a result of segregation of P at the grain boundaries of the welded part, due to heat input during welding.

Furthermore, high temperature fatigue characteristics of a welded part are not improved by controlling the amount of phosphide. Accordingly, high temperature fatigue cracks cannot be prevented by the addition of P to the steel.

As described above, regarding improvements of secondary working embrittleness resistance and high temperature fatigue characteristics, various suggestions have been made. However, no ferritic stainless steel having both of these advantageous properties has been discovered.

It is an object of this invention to do so.

SUMMARY OF THE INVENTION

It is an object of the present invention to meet the aforementioned demand and to provide the significant advantages heretofore detailed.

It is a further object of the present invention to provide a ferritic stainless steel in which both secondary working embrittleness resistance and high temperature fatigue characteristic of welded parts are improved.

A ferritic stainless steel and a ferritic stainless steel welded part are provided with both superior secondary working embrittleness resistance and high temperature fatigue characteristic in accordance with this invention.

The ferritic stainless steel of this invention has a composition, on a weight percentage basis, composed of about: 0.02% or less of C., 0.2% to 1.0% of Si, 0.1% to 1.5% of Mn, 0.04% or less of P, 0.01% or less of S, 11.0% to 20.0% of Cr, 0.1% to 1.0% of Ni, 1.0% to 2.0% of Mo, 1.0% or less of Al, 0.2% to 0.8% of Nb, 0.02% or less of N, 0.01% to 0.3% of Co, 0.01% to 0.3% of V, 0.0002% to 0.0050% of B, and the remainder Fe and incidental impurities.

The ferritic stainless steel contents of Co, V, and B preferably fall within the range represented by the following formula $$0.1 \leqq [Co]+0.5\times[V]+100\times[B] \leqq 0.5$$

where [Co], [V] and [B] designate the contents by weight percentages of the respective elements.

The aforementioned ferritic stainless steel preferably has a composition, on a weight percentage basis, further comprising at least one element selected from the group consisting of about 0.05% to 0.5% of Ti, about 0.05% to 0.5% of Zr, and about 0.05% to 0.5% of Ta.

The aforementioned ferritic stainless steel preferably has a composition, on a weight percentage basis, further comprising about 0.1% to 2.0% of Cu.

The aforementioned ferritic stainless steel preferably has a composition, on a weight percentage basis, comprising at least one element selected from the group consisting of about 0.05% to 1.0% of W and about 0.001% to 0.1% of Mg.

The aforementioned ferritic stainless steel preferably has a composition, on a weight percentage basis, further comprising about 0.0005% to 0.005% of Ca.

DESCRIPTION OF THE PREFERRED EMBODIMENTS

In order to achieve the aforementioned objects, we have closely investigated effects of various additive elements on the secondary working embrittleness resistance and the high temperature fatigue characteristic of welded parts of ferritic stainless steel.

As a consequence, we have discovered that the secondary working embrittleness resistance and the high temperature fatigue characteristics of a welded part were both remarkably improved by the addition of very small amounts of Co, V, and B.

Figure 1:
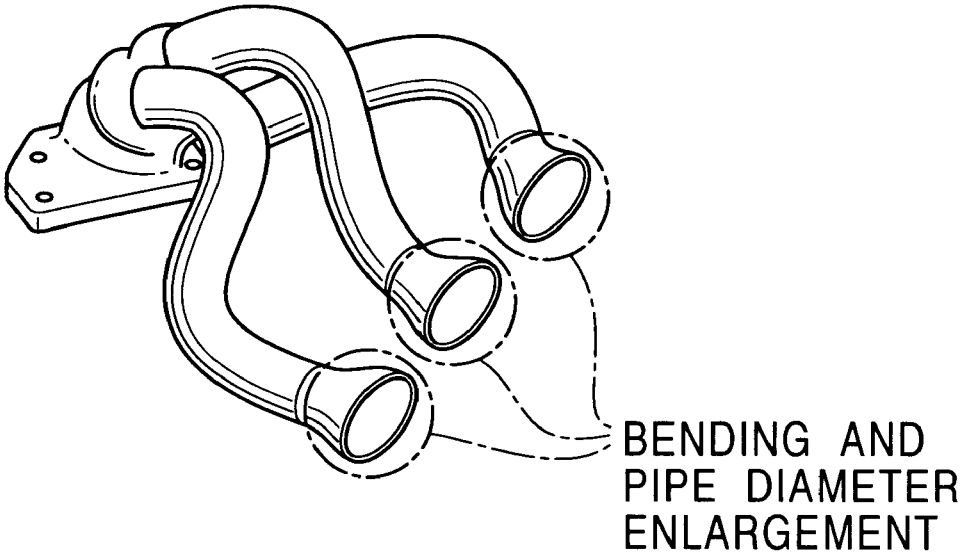
FIG. 1 is a schematic diagram of an exhaust manifold comprising a ferritic stainless steel in accordance with this invention.
Figure 2:
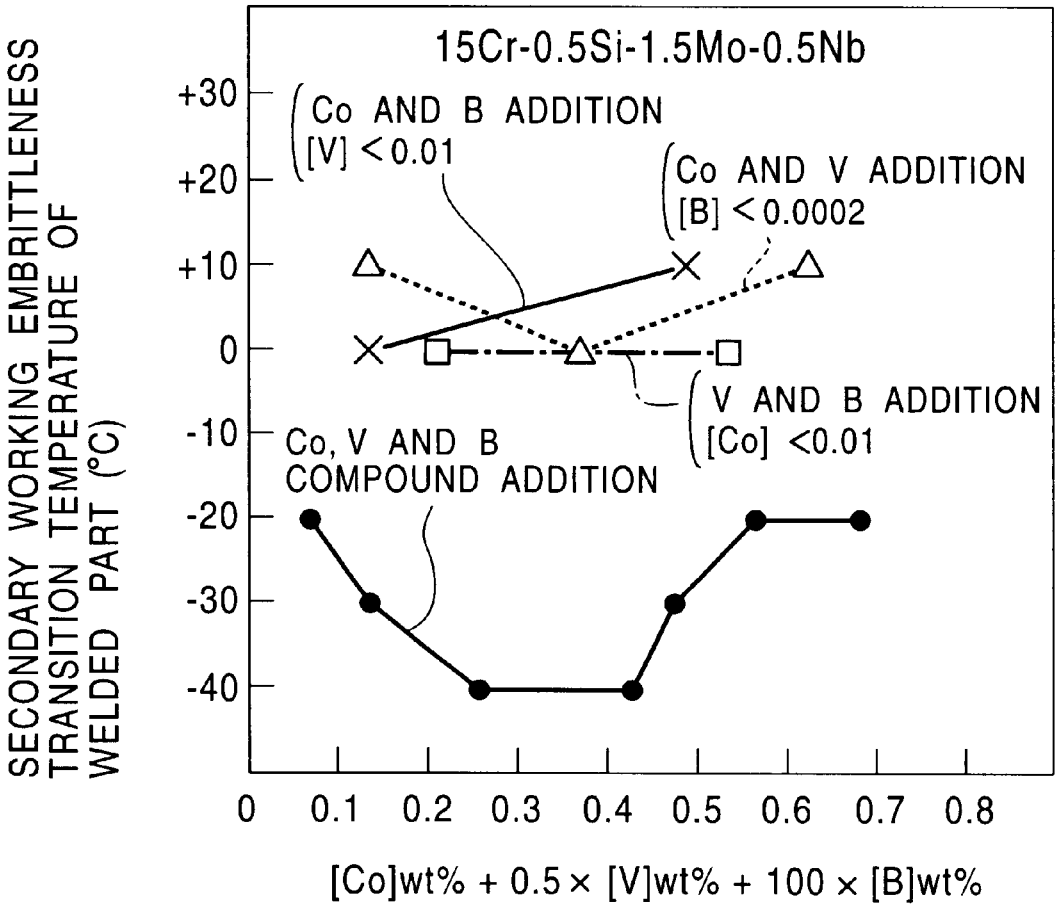
FIG. 2 is a graph showing the effects of Co, V, and B on secondary working embrittleness transition temperatures of welded parts such as the exhaust manifold of FIG. 1.

Results of the investigation regarding the effect of the addition of Co, V, and B on secondary working embrittleness transition temperatures of the welded parts are summarized as shown in FIG. 2.

As is clear from FIG. 2, in the case in which all three elements Co, V, and B are added, secondary working embrittleness transition temperatures are surprisingly lower than those where only two of the aforementioned three elements are added. This indicates that cracks due to brittleness do not occur during use at a lower temperature.

In particular, when contents of Co, V, and B fall within the range represented by the following formula $$0.1 \leqq [Co]+0.5\times[V]+100\times[B] \leqq 0.5$$

where [Co], [V], and [B] designate the contents of the stated elements by weight percentage of the respective elements, a further decrease in brittleness transition temperature was discovered.

Furthermore, when the relationship among the high temperature fatigue characteristics of welded parts and the Co, V, and B contents were also investigated, we discovered that the addition of Co, V, and B surprisingly had a beneficial effect on the high temperature fatigue characteristics of the product.

Figure 3:
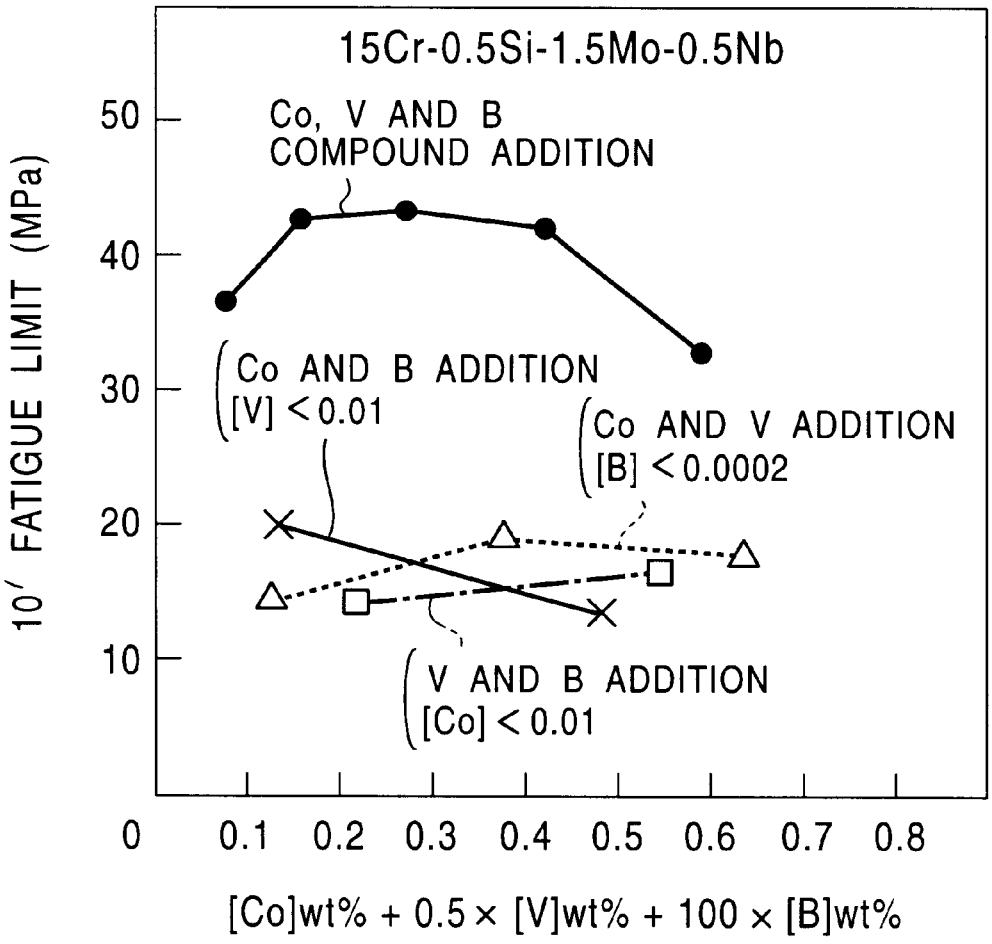
FIG. 3 is a graph similar to FIG. 2 showing effects of Co, V, and B on high temperature fatigue characteristics ($10^7$ fatigue limit (MPa)) of such welded parts.

Results of the investigation regarding the effect of Co+V+B on the high temperature fatigue characteristics are summarized as shown in FIG. 3.

The expression "$10^7$ fatigue limit" as used herein means the maximum bending stress with which bending was repeated $10^7$ times without any occurrence of any fatigue crack of welded parts.

As is clear from FIG. 3, in the case in which all three elements Co, V, and B, were added, the 10fatigue limits were substantially improved, compared to those where only two of those elements were added. This indicates that the welded part can withstand higher stresses created by highly repetitive bending.

In particular, when the contents of those elements fall approximately within the range represented by the following formula, $$0.1 \leqq [Co]+0.5\times[V]+100\times[B] \leqq 0.5$$

significantly higher $10^7$ fatigue limits were exhibited.

Reasons for limiting the components of the steel of this invention are as follows. The term "%" means the weight percentage (mass %) unless otherwise specified.

C: about 0.02% or less

C, when added in an appropriate amount, functions to strengthen the grain boundaries of the steel and improves the secondary working embrittleness resistance of welded parts. However, when C is increased and carbide is produced and deposited at the grain boundaries, the secondary working embrittleness resistance is adversely affected. In particular, when C exceeds about 0.02%, the adverse effect becomes remarkable. Therefore, C is specified to be about 0.02% or less. In particular, from the viewpoint of improving the secondary working embrittleness resistance, the content is preferably within the range of about $0.003\% < C \leqq 0.01\%$.

Si: about 0.2% to 1.0%

Si is useful in this invention in that it contributes effectively to an increase in strength and to improve the high temperature fatigue characteristics. In order to achieve this advantage, the Si content must be about 0.2% or more, although when the Si content exceeds about 1.0%, the steel becomes brittle, and the secondary working embrittleness resistance of the welded part is degraded. Therefore the Si content is specified to be about 0.2% to 1.0%. However, from the viewpoint of improving the secondary working embrittleness resistance of the welded part, the Si content is preferably about 0.6% or less.

Mn: about 0.1% or more, but about 1.5% or less

Since Mn is effective in improving oxidation resistance, it is necessary in materials used at high temperatures. The Mn content must be about 0.1% or more. However, when there are excessive amounts of Mn, not only the toughness of steel, but also the secondary working embrittleness resistance of a welded part is degraded. Therefore the Mn content is specified to be about 1.5% or less. However, from the viewpoint of improving the secondary working embrittleness resistance, the Mn content is preferably about 0.5% or less.

P: about 0.04% or less

P is likely to segregate at grain boundaries of the steel so as to reduce the strengthening effect at the grain boundaries by B as described below. Therefore, by minimizing the content of P, the secondary working embrittleness resistance and the high temperature fatigue characteristic of the welded part can be improved. However, when the P content is reduced too much, steel production costs increase. As a consequence, the upper limit of the P content is specified to be about 0.04%.

S: about 0.01% or less

When S is reduced, corrosion resistance, which is a characteristic of the stainless steel, is improved. However, the S content is specified to be about 0.01% or less due to economic constraints relating to desulfurization treatment in the steel making.

Cr: about 11.0% to 20.0%

Cr is effective in improving high temperature strength, oxidation resistance, and corrosion resistance. In order to exhibit sufficient high temperature strength, oxidation resistance, and corrosion resistance, Cr must be about 11.0% or more. On the other hand, Cr degrades the toughness of steel. In particular, when the Cr content exceeds about 20.0%, the toughness is remarkably degraded, and the secondary working embrittleness resistance of the welded part is also degraded. Therefore the Cr content is specified to be within the range of about 11.0% to 20.0%. In particular, from the viewpoint of improving high temperature fatigue characteristic, the Cr content is preferably about 14.0% or more. On the other hand, from the viewpoint of improving secondary working embrittleness resistance, the Cr content is preferably about 16.0% or less.

Ni: about 0.1% or more, but about 1.0% or less

Ni improves corrosion resistance, which is a characteristic of the stainless steel, and in order to improve the corrosion resistance, the Ni content must be about 0.1% or more. However, when the Ni content exceeds about 1.0%, the steel became hard, and the secondary working embrittleness resistance and the high temperature fatigue characteristic of the welded part are adversely affected.

Mo: about 1.0% to 2.0%

Mo is effective in improving high temperature strength and corrosion resistance. In order for the invented steel to exhibit sufficient high temperature strength and corrosion resistance, a Mo content must be about 1.0% or more. On the other hand, when the Mo content exceeds about 2.0%, the toughness is degraded, and the secondary working embrittleness resistance of the welded part is also degraded. Therefore the Mo content is specified to be within the range of about 1.0% to 2.0%. From the viewpoint of improving high temperature fatigue characteristic, the Mo content is preferably about 1.5% or more.

Al: about 1.0% or less

Al is essential as a deoxidizer in the steelmaking process, although excessive addition thereof causes production of an intervening material resulting in degradation of the secondary working embrittleness resistance. Therefore the Al content is specified to be about 1.0% or less. From the viewpoint of improving the secondary working embrittleness resistance, the Al content is preferably about 0.1% or less.

Nb: about 0.2% to 0.8%

Nb is effective in improving high temperature strength of the steel. In order for the invented steel to exhibit sufficient high temperature strength, a Nb content must be about 0.2% or more. On the other hand, when the Nb content exceeds about 0.8%, the toughness is degraded, and the secondary working embrittleness resistance of the welded part is also degraded. Therefore the Nb content is specified to be within the range of about 0.2% to 0.8%. From the viewpoint of improving the high temperature fatigue characteristic of the welded part, the Nb content preferably exceeds about 0.4%. On the other hand, from the viewpoint of improving the secondary working embrittleness resistance, the Nb content is preferably about 0.6% or less.

N: about 0.02% or less

When added in appropriate amounts, N functions to strengthen the grain boundaries and improves the secondary working embrittleness resistance of the steel. However, when nitride is produced and deposited at the grain boundaries, the secondary working embrittleness resistance is adversely affected particularly when the N content exceeds about 0.02%. Therefore, the N content is specified to be about 0.02% or less. From the viewpoint of improving the secondary working embrittleness resistance of the welded part, the N content is preferably about 0.01% or less.

Co: about 0.01% to 0.3%, V: about 0.01% to 0.3%, and B: about 0.0002% to 0.0050%

Both the secondary working embrittleness resistance and the high temperature fatigue characteristic of the welded part are remarkably improved by this compound addition of Co, V, and B. The aforementioned effect is exhibited when both the Co content and the V content are about 0.01% or more and the B content is about 0.0002% or more. In order for the steel of this invention to exhibit especially superior advantages, it is preferable that the Co content is about 0.02% or more, the V content is about 0.05% or more, and the B content is about 0.0005% or more. On the other hand, when the Co content exceeds about 0.3%, the V content exceeds about 0.3%, and the B content exceeds about 0.0050%, the effect reaches saturation even though the cost is increased. Therefore the contents of Co, V, and B are specified to be within the aforementioned range.

The mechanism by which the compound addition of Co, V, and B effectively contributes to improvement of the secondary working embrittleness resistance and the high temperature fatigue characteristic has not yet been exactly clarified, although it is believed to be as follows.

It is believed that Co improves the internal strength of grains which become coarse due to heat input during welding, and prevents cracks from occurring therein. It is believed that B coacts by segregating at the grain boundaries of the steel due to heat input, so as to strengthen the grain boundaries and to prevent formation of intergranular fractures. It is further believed that V also coacts by producing carbide due to the heat input so as to inhibit movement of the grain boundaries and to prevent crystal grains from becoming coarse, and that at the same time, V coacts by fixing C to prevent reduction of strengthening of the grain boundaries by B by deposition of carbide produced from B.

In the present invention, Co, V, and B interact with each other so as to exhibit a remarkable effect. If there is an insufficiency of the amount present of at least one of them, the aforementioned advantages cannot be enjoyed.

As described above, the addition of all of Co, V, and B results in a remarkable improvement in the secondary working embrittleness resistance of the welded part. Furthermore, it is believed that the aforementioned strengthening of the inside of the grain and the grain boundaries also contributes to the effects on the high temperature fatigue exhibited when Co, V, and B are added in approximately the following relationship:

$$0.1 \leqq [Co]+0.5\times[V]+100\times[B] \leqq 0.5$$

In addition, since the secondary working embrittleness resistance and the high temperature fatigue characteristic can be further improved by the addition of Co, V, and B with contents falling within the range represented substantially by the aforementioned formula, as shown in the aforementioned FIGS. 2 and 3, it is preferable that contents of these elements are made to fall within the approximate range represented by the aforementioned formula.

The indispensable components of the invented steel have been explained above, although in the present invention, other elements as described below can be added:

Ti: about 0.05% or more, but about 0.5% or less, Zr: about 0.05% or more, but about 0.5% or less, and Ta: about 0.05% or more, but about 0.5% or less The elements Ti, Zr, and Ta are useful in that they deposit as carbide due to heat input during welding, and so contribute to improvement of high temperature fatigue characteristics by strengthening due to the deposition thereof. When these elements are added, the content of each must be about 0.05% or more. However, when content of each exceeds about 0.5%, the effect reaches saturation, and surface properties of the steel plate are remarkably degraded. Therefore, each of the contents is specified to be about 0.5% or less.

Cu: about 0.1% or more, but about 2.0% or less

Cu is effective in improving corrosion resistance and toughness of steel. When Cu is added, the Cu content must be about 0.1% or more. When the Cu content exceeds about 2.0%, however, workability of steel is degraded. Therefore, the upper limit of the Cu content is specified to be about 2.0%.

W: about 0.05% or more, but about 1.0% or less, Mg: about 0.001% or more, but about 0.1% or less Each of W and Mg is effective in improving high temperature fatigue characteristics. When W and Mg are added, the W content and the Mg content must be about 0.05% or more and about 0.001% or more, respectively. When the W content and the Mg content exceed about 1.0% and about 0.1%, respectively, however, toughness is degraded, and the secondary working embrittleness resistance of the welded part is also degraded. Therefore, the W content and the Mg content are specified to be within the aforementioned range, respectively.

Ca: about 0.0005% or more, but about 0.005% or less

Ca has an effect of preventing nozzle plugging due to a Ti-based intervening material during slab casting, and Ca is added if necessary. When Ca is added, the Ca content must be about 0.0005% or more. However, when the Ca content exceeds about 0.005%, the effect reaches saturation, and corrosion resistance is degraded, since an intervening material containing Ca becomes a starting point of development of pitting corrosion. Therefore, the Ca content is specified to be about 0.005% or less.

The remainder is essentially composed of Fe and incidental impurities. This means that very small amounts of, for example, alkali metals, alkaline-earth metals, rare earth elements, and transition metals, other than Fe, will inevitably be present as admixed components. When very small amounts of these elements are present, the effects of the present invention are not affected.

Next, a method for manufacturing the steel of this invention will be explained.

The method for manufacturing the invented steel is not specifically limited, and a generally adopted method for manufacturing ferritic stainless steel can be applied as it is conventionally used. For example, regarding steel making, a method in which a molten steel having a composition in the aforementioned range is preferably refined with a converter or an electric furnace, etc., and is then subjected to a secondary refining by VOD (Vacuum Oxygen Decarburization). The refined molten steel can be made into a steel raw material by known methods for casting, although continuous casting is preferably applied, from the viewpoint of productivity and quality.

The resulting steel raw material produced by the continuous casting is heated to 1,000° C. to 1,250° C., and made into a hot rolled plate having a predetermined thickness. The resulting hot rolled plate is, if necessary, preferably subjected to continuous annealing at a temperature of 900° C. to 1,100° C., and thereafter subjected to pickling and cold rolling so as to produce a cold rolled plate. The resulting cold rolled plate is preferably continuously annealed at 900° C. to 1,100° C., and thereafter, is pickled so as to produce a cold rolled annealed plate which becomes a product.

The product, which is produced by way of hot rolling, annealing, and thereafter pickling, etc., for removing scales, can also be used depending on the purpose intended.

Any conventional method for welding, for example, arc welding, e.g. TIG, MIG, and MAG, high frequency resistance welding and high frequency induction welding used for producing electric resistance weld pipes, and laser welding, can be applied.

EXAMPLES

Each of 50 kg steel ingots, which become test specimens having compositions as shown in Tables 1 to 3, was refined by a vacuum melting furnace, and was made into a hot rolled plate of 4 mm in thickness by the usual hot rolling. The resulting plate was subjected to annealing at 1,000° C. for 60 seconds. Scale was removed from the surface by pickling, and thereafter, a cold rolled plate 1.5 mm in thickness was produced by cold rolling. Subsequently, annealing finishing at 1,000° C. for 60 seconds and pickling for removing scales were performed so as to produce a cold rolled, annealed, and pickled plate 1.5 mm in thickness as a test specimen.

Butt TIG welding was applied to each of the resulting test specimens, and thereafter, each welded test specimen was subjected to secondary working embrittleness testing and high temperature fatigue testing. The TIG welding was performed under the following conditions; current 240 A, voltage 12 V, welding speed 10 mm/s, and shield gas 100% Ar.

Figure 4:
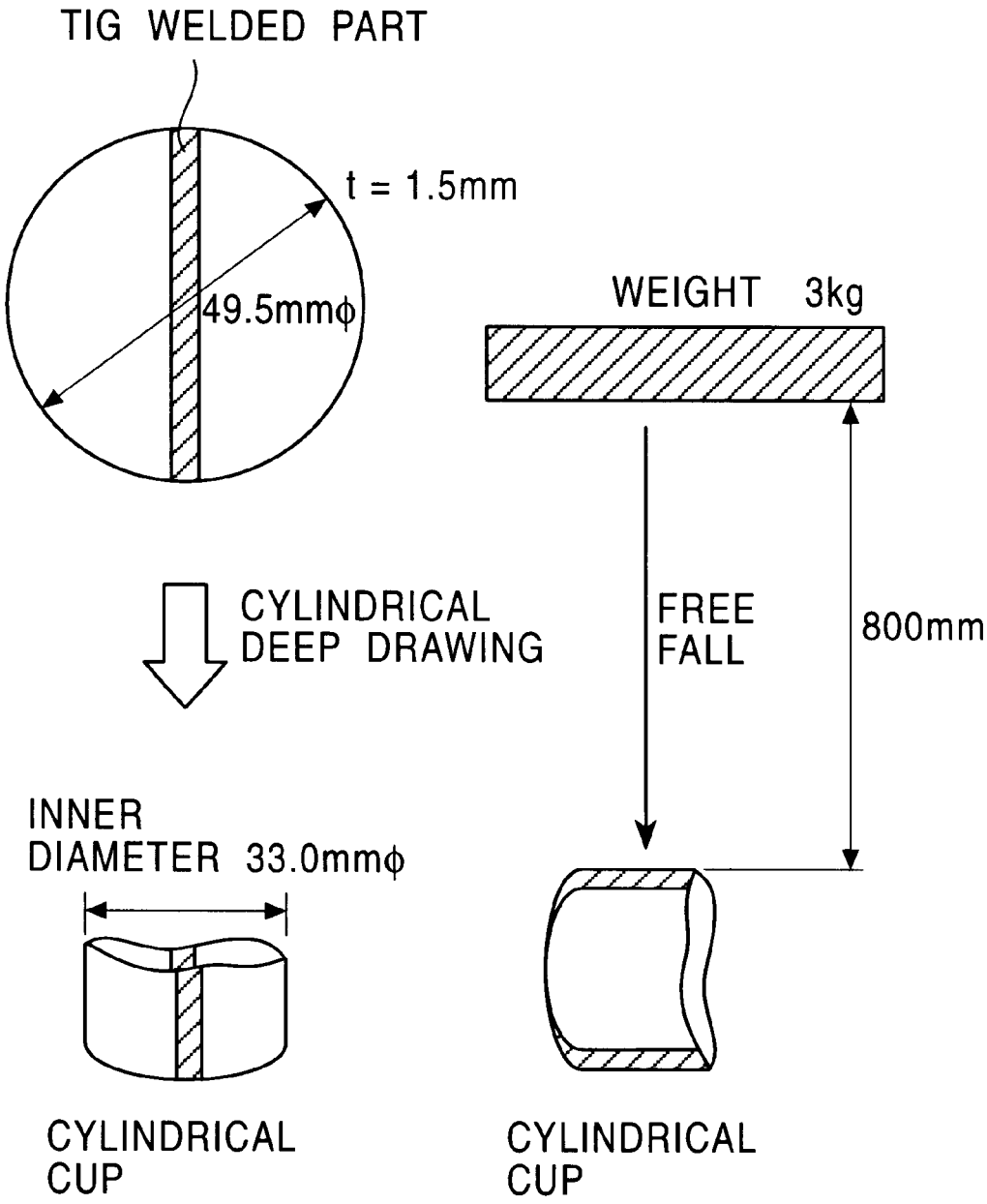
FIG. 4 is a schematic diagram illustrating a test for evaluation of secondary working embrittleness resistance of such welded parts.

A method for evaluating secondary working embrittleness resistance is shown in FIG. 4. That is, a disk 49.5 mm in diameter, in which the bead of welding passed through the center of the disk, was stamped out. Then, the disk was subjected to deep drawing with a draw ratio of 1.5 using a cylindrical punch 33.0 mm in diameter. The resulting cylindrical cup was placed, so that the welded part on the side thereof facing upward, then a weight of 3kg was dropped from a height of 800 mm directly above the cylindrical cup. Thereafter, the welded part was observed to determine whether or not cracks were present. The aforementioned drop weight tests were performed, while temperatures of the cylindrical cup were varied in the range of −60° C. to +50° C. at intervals of 10° C., in order to determine the temperatures (secondary working embrittleness transition temperature) at which cracking did not occur.

Figure 5:
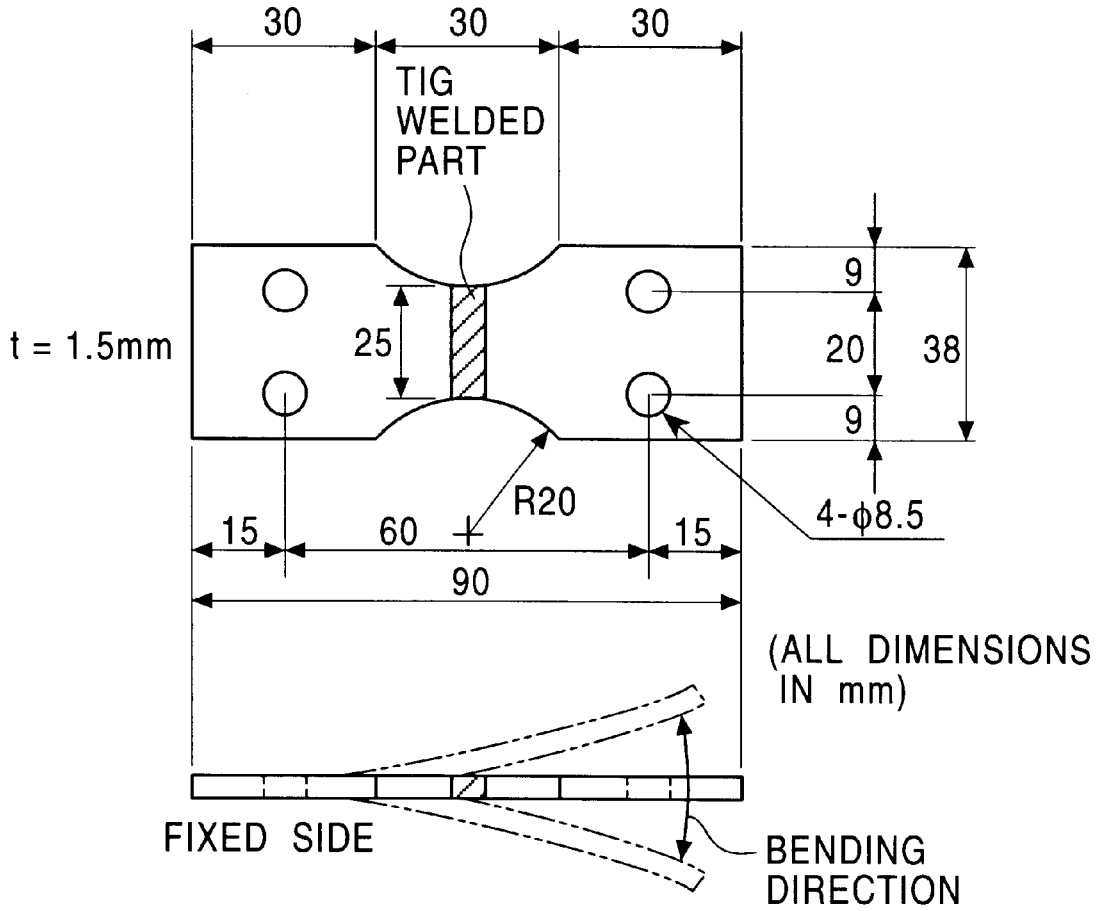
FIG. 5 is a schematic diagram illustrating one example of a shape of a test piece used in a high temperature fatigue test, and a bending direction thereof.

Regarding the high temperature fatigue test, the $10^7$ fatigue limit (the maximum bending stress with which bending was repeated $10^7$ times without the occurrence of a fatigue crack) was measured by a flex (reversed stress) test at 800° C. in conformity with JIS Z 2275 using a test piece in which a TIG welded bead is located at the center as shown in FIG. 5. Herein, the bending stress o was determined as described below. Bending deformation was applied to each test piece, and a bending moment M (Nm) was measured regarding the section at which the maximum stress was generated (a section of the TIG welded bead part as shown in FIG. 5). Subsequently, the value of the bending moment was divided by the modulus of the section in order to calculate the value of the bending stress.

The results of the aforementioned tests are shown in Tables 4 and 5.

As is clear from Tables 4 and 5, each of the steels of this invention Nos. 1 to 36, was proved to be superior in both secondary working embrittleness resistance and high temperature fatigue characteristics of the welded part.

On the other hand, regarding each of Comparative Steels Nos. 37 to 56, the secondary working embrittleness resistance and the high temperature fatigue characteristic were sharply inferior to the steels Nos. 1–36.

As described above, according to the present invention, a ferritic stainless steel, including a welded part having superior secondary working embrittleness resistance and superior high temperature fatigue characteristic, was stably produced. As a consequence, in the case in which a welded pipe or a welded plate after forming work is used, cracks during use were effectively prevented from occurring.

The steel of this invention is suitable for many purposes, for example, components relating to automobile exhaust gas, in particular, exhaust manifolds, etc., in which a welded pipe is subjected to complicated bending work and used at a high temperature. The welded part of the steel of this invention exhibits excellent toughness and high temperature fatigue characteristics when it is used without further working or after primary working, so that it can also be applied to such a use with advantage.

It is noted that, in the foregoing Examples 1–36, the values of the formula [Co]+0.5[V]+100[B], in accordance with this invention, can range between 0.07 and 0.57, with excellent results. As stated, in the formula the expressions [Co], [V] and [B] represent the contents by weight percentage.

TABLE 1

| | Chemical Component (mass %) | | | | | | | | | | | | | | | |
|---|---|---|---|---|---|---|---|---|---|---|---|---|---|---|---|---|
| No. | C | Si | Mn | P | S | Cr | Ni | Mo | Al | Nb | N | Co | V | B | Formula 1 | Others |
| 1 | 0.004 | 0.35 | 0.22 | 0.03 | 0.003 | 11.3 | 0.3 | 1.1 | 0.03 | 0.45 | 0.004 | 0.07 | 0.05 | 0.0009 | 0.19 | |
| 2 | 0.005 | 0.25 | 0.28 | 0.02 | 0.003 | 11.8 | 0.2 | 1.5 | 0.03 | 0.58 | 0.004 | 0.08 | 0.06 | 0.0008 | 0.19 | Ti: 0.13 |
| 3 | 0.008 | 0.23 | 0.18 | 0.03 | 0.001 | 11.2 | 0.3 | 1.0 | 0.02 | 0.22 | 0.006 | 0.05 | 0.07 | 0.0005 | 0.14 | Ca: 0.0012 |
| 4 | 0.016 | 0.36 | 0.21 | 0.01 | 0.003 | 11.3 | 0.4 | 1.2 | 0.02 | 0.48 | 0.009 | 0.12 | 0.06 | 0.0012 | 0.27 | Mg: 0.0010 |
| 5 | 0.004 | 0.30 | 0.21 | 0.03 | 0.003 | 14.8 | 0.3 | 1.6 | 0.03 | 0.45 | 0.006 | 0.02 | 0.05 | 0.0006 | 0.11 | |
| 6 | 0.003 | 0.95 | 0.43 | 0.03 | 0.005 | 14.5 | 0.4 | 1.5 | 0.08 | 0.55 | 0.002 | 0.14 | 0.09 | 0.0006 | 0.25 | |
| 7 | 0.004 | 0.47 | 0.18 | 0.01 | 0.002 | 14.2 | 0.5 | 2.0 | 0.03 | 0.46 | 0.004 | 0.22 | 0.21 | 0.0008 | 0.41 | W: 0.14 |
| 8 | 0.006 | 0.38 | 0.32 | 0.03 | 0.005 | 13.5 | 0.2 | 1.6 | 0.06 | 0.52 | 0.009 | 0.01 | 0.16 | 0.0009 | 0.18 | Ti: 0.12 |
| 9 | 0.004 | 0.23 | 0.43 | 0.04 | 0.002 | 14.8 | 0.1 | 1.7 | 0.03 | 0.43 | 0.006 | 0.11 | 0.07 | 0.0002 | 0.17 | Zr: 0.06 |
| 10 | 0.006 | 0.31 | 0.46 | 0.02 | 0.003 | 14.2 | 0.2 | 1.7 | 0.05 | 0.55 | 0.005 | 0.02 | 0.09 | 0.0009 | 0.16 | Ti: 0.13 |
| 11 | 0.008 | 0.43 | 0.12 | 0.03 | 0.005 | 15.8 | 0.3 | 1.8 | 0.01 | 0.48 | 0.009 | 0.05 | 0.14 | 0.0007 | 0.19 | Cu: 0.15 |
| 12 | 0.005 | 0.38 | 0.32 | 0.03 | 0.003 | 14.6 | 0.5 | 1.5 | 0.03 | 0.42 | 0.006 | 0.06 | 0.12 | 0.0005 | 0.17 | W: 0.06 |
| 13 | 0.002 | 0.28 | 0.22 | 0.02 | 0.002 | 14.8 | 0.3 | 1.6 | 0.02 | 0.48 | 0.006 | 0.08 | 0.07 | 0.0005 | 0.17 | Ta: 0.05 |
| 14 | 0.005 | 0.25 | 0.26 | 0.03 | 0.003 | 14.1 | 0.3 | 1.7 | 0.02 | 0.47 | 0.008 | 0.02 | 0.04 | 0.0003 | 0.07 | |
| 15 | 0.004 | 0.35 | 0.23 | 0.01 | 0.004 | 15.3 | 0.5 | 1.5 | 0.04 | 0.53 | 0.004 | 0.18 | 0.01 | 0.0025 | 0.44 | Cu: 0.25 |
| 16 | 0.006 | 0.36 | 1.46 | 0.02 | 0.008 | 14.8 | 0.2 | 1.7 | 0.02 | 0.43 | 0.003 | 0.03 | 0.07 | 0.0005 | 0.12 | Ca: 0.0007 |
| 17 | 0.016 | 0.31 | 0.20 | 0.02 | 0.003 | 15.8 | 0.3 | 1.3 | 0.02 | 0.45 | 0.006 | 0.05 | 0.07 | 0.0006 | 0.15 | |
| 18 | 0.009 | 0.68 | 0.23 | 0.01 | 0.003 | 15.3 | 0.9 | 1.5 | 0.01 | 0.43 | 0.006 | 0.05 | 0.06 | 0.0008 | 0.16 | Ti: 0.11, Cu: 0.53 |

Formula 1 = [Co] + 0.5 × [V] + 100 × [B]

TABLE 2

| | Chemical Component (mass %) | | | | | | | | | | | | | | | |
|---|---|---|---|---|---|---|---|---|---|---|---|---|---|---|---|---|
| No. | C | Si | Mn | P | S | Cr | Ni | Mo | Al | Nb | N | Co | V | B | Formula 1 | Others |
| 19 | 0.004 | 0.38 | 0.33 | 0.03 | 0.007 | 15.0 | 0.2 | 1.2 | 0.05 | 0.23 | 0.008 | 0.03 | 0.08 | 0.0008 | 0.15 | Ti: 0.06, Zr: 0.08 |
| 20 | 0.009 | 0.35 | 0.27 | 0.02 | 0.003 | 14.3 | 0.2 | 1.6 | 0.03 | 0.43 | 0.005 | 0.08 | 0.03 | 0.0007 | 0.17 | Ca: 0.0009 |
| 21 | 0.007 | 0.53 | 0.25 | 0.03 | 0.006 | 14.9 | 0.3 | 1.7 | 0.02 | 0.52 | 0.009 | 0.05 | 0.07 | 0.0008 | 0.17 | Ti: 0.15, Cu: 0.35 |
| 22 | 0.004 | 0.33 | 0.28 | 0.004 | 0.003 | 15.3 | 0.3 | 1.9 | 0.002 | 0.51 | 0.007 | 0.07 | 0.09 | 0.0007 | 0.19 | Ti: 0.11, W: 0.13 |
| 23 | 0.006 | 0.46 | 0.19 | 0.01 | 0.005 | 15.2 | 0.4 | 1.7 | 0.04 | 0.49 | 0.008 | 0.13 | 0.05 | 0.0003 | 0.19 | Ti: 0.12, Zr: 0.07 |
| 24 | 0.008 | 0.39 | 0.21 | 0.03 | 0.003 | 14.8 | 0.1 | 1.8 | 0.002 | 0.48 | 0.006 | 0.16 | 0.15 | 0.0009 | 0.33 | Ti: 0.05, Ca: 0.0008 |
| 25 | 0.006 | 0.28 | 0.22 | 0.02 | 0.002 | 15.4 | 0.2 | 1.5 | 0.02 | 0.45 | 0.009 | 0.20 | 0.23 | 0.0025 | 0.57 | |
| 26 | 0.007 | 0.53 | 0.25 | 0.03 | 0.006 | 14.9 | 0.3 | 1.7 | 0.02 | 0.52 | 0.009 | 0.05 | 0.07 | 0.0008 | 0.17 | Ti: 0.11, Cu: 0.22, Ca: 0.0010 |
| 27 | 0.009 | 0.35 | 0.27 | 0.02 | 0.003 | 14.3 | 0.2 | 1.6 | 0.03 | 0.43 | 0.005 | 0.08 | 0.08 | 0.0012 | 0.24 | Ti: 0.13, Cu: 0.09, Ca: 0.0012 |
| 28 | 0.005 | 0.38 | 0.32 | 0.03 | 0.003 | 14.6 | 0.5 | 1.5 | 0.03 | 0.42 | 0.006 | 0.06 | 0.12 | 0.0005 | 0.17 | Cu: 0.18, W: 0.12 |
| 29 | 0.005 | 0.29 | 0.35 | 0.03 | 0.008 | 14.1 | 0.4 | 1.6 | 0.03 | 0.53 | 0.017 | 0.24 | 0.06 | 0.0007 | 0.34 | Zr: 0.12, Cu: 0.24 |
| 30 | 0.010 | 0.33 | 0.23 | 0.01 | 0.006 | 14.8 | 0.5 | 1.7 | 0.31 | 0.49 | 0.009 | 0.10 | 0.26 | 0.0005 | 0.28 | |
| 31 | 0.004 | 0.38 | 0.42 | 0.02 | 0.003 | 15.3 | 0.1 | 1.5 | 0.03 | 0.57 | 0.010 | 0.28 | 0.08 | 0.0009 | 0.41 | Cu: 0.12, Ca: 0.0014 |
| 32 | 0.008 | 0.43 | 0.14 | 0.03 | 0.007 | 15.4 | 0.2 | 1.8 | 0.05 | 0.48 | 0.006 | 0.02 | 0.05 | 0.0046 | 0.51 | Cu: 0.61 |
| 33 | 0.003 | 0.28 | 0.26 | 0.02 | 0.008 | 14.3 | 0.6 | 1.7 | 0.03 | 0.78 | 0.005 | 0.08 | 0.06 | 0.0008 | 0.19 | Ti: 0.10 |
| 34 | 0.009 | 0.31 | 0.71 | 0.01 | 0.003 | 15.2 | 0.3 | 1.6 | 0.95 | 0.42 | 0.007 | 0.05 | 0.08 | 0.0006 | 0.15 | |
| 35 | 0.005 | 0.21 | 0.31 | 0.03 | 0.005 | 18.2 | 0.2 | 1.7 | 0.05 | 0.48 | 0.008 | 0.12 | 0.11 | 0.0008 | 0.26 | Ti: 0.15 |
| 36 | 0.006 | 0.39 | 0.37 | 0.03 | 0.005 | 19.8 | 0.1 | 1.5 | 0.02 | 0.41 | 0.004 | 0.07 | 0.05 | 0.0010 | 0.20 | |

Formula 1 = [Co] + 0.5 × [V] + 100 × [B]

TABLE 3

| No. | Chemical Component (mass %) | | | | | | | | | | | | | | | |
|---|---|---|---|---|---|---|---|---|---|---|---|---|---|---|---|---|
| | C | Si | Mn | P | S | Cr | Ni | Mo | Al | Nb | N | Co | V | B | Formula 1 | Others |
| 37 | 0.006 | 0.14 | 0.43 | 0.03 | 0.004 | 14.5 | 0.4 | 1.4 | 0.04 | 0.45 | 0.004 | 0.13 | 0.07 | 0.0003 | 0.20 | |
| 38 | 0.004 | 0.34 | 0.24 | 0.03 | 0.003 | 14.9 | 1.1 | 1.6 | 0.03 | 0.42 | 0.004 | 0.06 | 0.06 | 0.0008 | 0.17 | |
| 39 | 0.008 | 0.35 | 1.62 | 0.02 | 0.005 | 15.2 | 0.3 | 1.7 | 0.05 | 0.58 | 0.005 | 0.08 | 0.15 | 0.0002 | 0.18 | |
| 40 | 0.025 | 0.45 | 0.26 | 0.01 | 0.008 | 15.9 | 0.4 | 1.3 | 0.03 | 0.51 | 0.006 | 0.12 | 0.06 | 0.0005 | 0.20 | |
| 41 | 0.008 | 0.43 | 0.12 | 0.05 | 0.005 | 15.8 | 0.3 | 1.8 | 0.01 | 0.48 | 0.009 | 0.05 | 0.14 | 0.0007 | 0.19 | Cu: 0.10 |
| 42 | 0.008 | 0.72 | 0.21 | 0.03 | 0.003 | 14.2 | 0.4 | 0.8 | 0.04 | 0.42 | 0.009 | 0.11 | 0.21 | 0.0005 | 0.27 | |
| 43 | 0.010 | 0.35 | 0.28 | 0.02 | 0.007 | 14.8 | 0.3 | 1.4 | 1.19 | 0.48 | 0.005 | 0.09 | 0.06 | 0.0007 | 0.19 | |
| 44 | 0.006 | 0.37 | 0.31 | 0.01 | 0.007 | 14.7 | 0.2 | 1.2 | 0.05 | 0.14 | 0.007 | 0.04 | 0.09 | 0.0010 | 0.19 | |
| 45 | 0.004 | 0.35 | 0.19 | 0.03 | 0.010 | 15.7 | 0.2 | 1.4 | 0.02 | 0.48 | 0.026 | 0.08 | 0.14 | 0.0005 | 0.20 | Ti: 0.13 |
| 46 | 0.006 | 0.42 | 0.29 | 0.04 | 0.008 | 15.3 | 0.3 | 1.2 | 0.03 | 0.52 | 0.004 | <0.01 | 0.08 | 0.0012 | 0.16 | |
| 47 | 0.004 | 0.32 | 0.21 | 0.03 | o.004 | 15.2 | 0.1 | 1.3 | 0.03 | 0.54 | 0.005 | 0.07 | <0.01 | 0.0006 | 0.13 | Cu: 0.21 |
| 48 | 0.009 | 0.45 | 0.26 | 0.01 | 0.005 | 14.0 | 0.4 | 1.4 | 0.06 | 0.48 | 0.007 | 0.05 | 0.09 | <0.0002 | 0.10 | Ti: 0.15, Cu: 0.31 |
| 49 | 0.007 | 0.42 | 0.27 | 0.02 | 0.003 | 14.9 | 0.2 | 1.4 | 0.04 | 0.45 | 0.010 | <0.01 | <0.01 | 0.0007 | 0.07 | Zr: 0.13 |
| 50 | 0.005 | 0.27 | 0.18 | 0.01 | 0.007 | 15.5 | 0.1 | 1.3 | 0.03 | 0.42 | 0.006 | <0.01 | <0.01 | <0.0002 | 0.00 | Ti: 0.12, Ca: 0.0011 |
| 51 | 0.004 | 0.27 | 0.16 | 0.03 | 0.007 | 15.3 | 0.3 | 1.3 | 0.02 | 0.51 | 0.004 | 0.13 | <0.01 | <0.0002 | 0.13 | W: 0.09 |
| 52 | 0.007 | 0.39 | 0.19 | 0.01 | 0.005 | 14.3 | 0.3 | 1.1 | 0.04 | 0.50 | 0.008 | <0.01 | 0.07 | <0.0002 | 0.04 | Ca: 0.0017 |
| 53 | 0.006 | 1.12 | 0.23 | 0.03 | 0.008 | 15.8 | 0.2 | 1.7 | 0.002 | 0.52 | 0.004 | 0.06 | 0.06 | 0.0009 | 0.18 | |
| 54 | 0.003 | 0.37 | 0.26 | 0.02 | 0.005 | 15.2 | 0.3 | 1.8 | 0.15 | 0.90 | 0.006 | 0.08 | 0.07 | 0.0005 | 0.17 | Ti: 0.15 |
| 55 | 0.004 | 0.35 | 0.36 | 0.03 | 0.010 | 14.7 | 0.2 | 2.2 | 0.02 | 0.43 | 0.003 | 0.12 | 0.14 | 0.0010 | 0.29 | |
| 56 | 0.005 | 0.35 | 0.21 | 0.03 | 0.007 | 21.1 | 0.3 | 1.6 | 0.01 | 0.58 | 0.006 | 0.08 | 0.08 | 0.0008 | 0.20 | |

TABLE 4

| No. | $10^7$ fatigue limit of welded part (MPa) | Secondary working embrittleness transition temperature of welded part (° C.) | Remarks |
|---|---|---|---|
| 1 | 31 | −30 | Present Invention |
| 2 | 33 | −30 | Present Invention |
| 3 | 30 | −30 | Present Invention |
| 4 | 30 | −20 | Present Invention |
| 5 | 38 | −30 | Present Invention |
| 6 | 35 | −20 | Present Invention |
| 7 | 41 | −30 | Present Invention |
| 8 | 33 | −20 | Present Invention |
| 9 | 32 | −20 | Present Invention |
| 10 | 43 | −30 | Present Invention |
| 11 | 38 | −40 | Present Invention |
| 12 | 41 | −30 | Present Invention |
| 13 | 37 | −20 | Present Invention |
| 14 | 31 | −20 | Present Invention |
| 15 | 32 | −20 | Present Invention |
| 16 | 35 | −20 | Present Invention |
| 17 | 30 | −20 | Present Invention |
| 18 | 31 | −20 | Present Invention |
| 19 | 33 | −30 | Present Invention |
| 20 | 33 | −20 | Present Invention |
| 21 | 43 | −40 | Present Invention |
| 22 | 45 | −30 | Present Invention |
| 23 | 34 | −20 | Present Invention |
| 24 | 41 | −30 | Present Invention |
| 25 | 32 | −20 | Present Invention |
| 26 | 43 | −40 | Present Invention |
| 27 | 44 | −30 | Present Invention |
| 28 | 42 | −40 | Present Invention |

TABLE 5

| No. | $10^7$ fatigue limit of welded part (MPa) | Secondary working embrittleness transition temperature of welded part (° C.) | Remarks |
|---|---|---|---|
| 29 | 40 | −20 | Present Invention |
| 30 | 37 | −20 | Present Invention |
| 31 | 36 | −40 | Present Invention |

TABLE 5-continued

| No. | $10^7$ fatigue limit of welded part (MPa) | Secondary working embrittleness transition temperature of welded part (° C.) | Remarks |
|---|---|---|---|
| 32 | 31 | −20 | Present Invention |
| 33 | 39 | −20 | Present Invention |
| 34 | 36 | −20 | Present Invention |
| 35 | 39 | −20 | Present Invention |
| 36 | 35 | −20 | Present Invention |
| 37 | 18 | −30 | Comparative Example |
| 38 | 15 | +10 | Comparative Example |
| 39 | 33 | +10 | Comparative Example |
| 40 | 26 | +10 | Comparative Example |
| 41 | 18 | +10 | Comparative Example |
| 42 | 15 | −20 | Comparative Example |
| 43 | 35 | +10 | Comparative Example |
| 44 | 15 | −30 | Comparative Example |
| 45 | 29 | +10 | Comparative Example |
| 46 | 16 | +10 | Comparative Example |
| 47 | 15 | 0 | Comparative Example |
| 48 | 16 | 0 | Comparative Example |
| 49 | 13 | +10 | Comparative Example |
| 50 | 14 | +10 | Comparative Example |
| 51 | 18 | +10 | Comparative Example |
| 52 | 16 | +10 | Comparative Example |
| 53 | 36 | +10 | Comparative Example |
| 54 | 38 | +10 | Comparative Example |
| 55 | 39 | +10 | Comparative Example |
| 56 | 35 | +10 | Comparative Example |

What is claimed is:

1. A ferritic stainless steel or welded part thereof, which has a composition, on a weight percentage basis, comprising about:

0.02% or less of C;

0.2% to 1.0% of Si;

0.1% to 1.5% of Mn;

0.04% or less of P;

0.01% or less of S;

11.0% to 20.0% of Cr;

0.1% to 1.0% of Ni;

1.0% to 2.0% of Mo;

1.0% or less of Al;

0.2% to 0.8% of Nb;

0.02% or less of N;

0.01% to 0.3% of Co;

0.01% to 0.3% of V;

0.0002% to 0.0050% of B; and the remainder being Fe and incidental impurities.

2. A ferritic stainless steel according to claim 1, wherein contents of Co, V, and B fall substantially within the range represented by the following formula $$0.1 \leqq [Co]+0.5\times[V]+100\times[B] \leqq 0.5$$

where [Co], [V] and [B] indicate contents by weight percentage.

3. A ferritic stainless steel according to claim 1, which has a composition, on a weight percentage basis, further comprising at least one element selected from the group consisting of about 0.05% to 0.5% of Ti, about 0.05% to 0.5% of Zr, and about 0.05% to 0.5% of Ta.

4. A ferritic stainless steel according to claim 1, which has a composition, on a weight percentage basis, further comprising about 0.1% to 2.0% of Cu.

5. A ferritic stainless steel according to claim 1, which has a composition, on a weight percentage basis, further comprising at least one element selected from the group consisting of about 0.05% to 1.0% of W and about 0.001% to 0.1% of Mg.

6. A ferritic stainless steel according to claim 1, which has a composition, on a weight percentage basis, further comprising about 0.0005% to 0.005% of Ca.

7. The ferritic stainless steel defined in claim 1, wherein the limits of the formula [Co]+0.5[V]+100[B] are from 0.07–0.57, where [Co], [V] and [B] indicate contents by weight percentage.

8. The steel or welded part thereof, as defined in claim 1, wherein the weight percentage Co is about 0.02 to 0.3%, the weight percentage V is about 0.05 to 0.3%, and the percentage B is about 0.0005 to 0.0050%.

9. The steel or welded part thereof, as defined in claim 1, wherein the weight percentage Cr is about 14–16.

* * * * *

UNITED STATES PATENT AND TRADEMARK OFFICE

CERTIFICATE OF CORRECTION

PATENT NO. : 6,426,039 B2
DATED : July 30, 2002
INVENTOR(S) : Hirasawa et al.

It is certified that error appears in the above-identified patent and that said Letters Patent is hereby corrected as shown below:

Column 3,
Line 57, please change "10fatigue" to -- $10^7$ fatigue --.

Signed and Sealed this

Fourth Day of February, 2003

JAMES E. ROGAN
*Director of the United States Patent and Trademark Office*